US005264409A

United States Patent [19]

Takahashi et al.

[11] Patent Number: 5,264,409

[45] Date of Patent: Nov. 23, 1993

[54] PRESSURE-SENSITIVE COPYING MATERIAL

[75] Inventors: Naoya Takahashi, Yokohama; Satoshi Narui, Ayase; Yasuo Togami, Yokohama, all of Japan

[73] Assignee: Nippon Petrochemicals Company, Limited, Tokyo, Japan

[21] Appl. No.: 838,772

[22] PCT Filed: Jul. 10, 1991

[86] PCT No.: PCT/JP91/00928

§ 371 Date: Mar. 10, 1992

§ 102(e) Date: Mar. 10, 1992

[87] PCT Pub. No.: WO92/00853

PCT Pub. Date: Jan. 23, 1992

[30] Foreign Application Priority Data

Jul. 10, 1990 [JP] Japan ..... 2-182471

[51] Int. Cl.[5] ..... B41M 5/165

[52] U.S. Cl. ..... 503/213; 503/215; 503/216; 503/224; 503/225

[58] Field of Search ..... 503/213, 225, 215, 216, 503/224

[56] References Cited

U.S. PATENT DOCUMENTS

| | | | |
|---|---|---|---|
| 4,686,548 | 8/1987 | Takahashi et al. | 503/213 |
| 4,879,269 | 11/1989 | Takahashi et al. | 503/213 |

FOREIGN PATENT DOCUMENTS

| | | |
|---|---|---|
| 2153634 | 5/1972 | Fed. Rep. of Germany . |
| 72-07024 | 3/1972 | France . |
| 72-37099 | 10/1972 | France . |
| 56-164889 | 12/1981 | Japan . |
| 61-5982 | 1/1986 | Japan . |
| 62-124978 | 6/1987 | Japan . |
| 62-234983 | 10/1987 | Japan . |
| 2187486 | 3/1987 | United Kingdom . |

*Primary Examiner*—Pamela R. Schwartz
*Attorney, Agent, or Firm*—Scully, Scott, Murphy & Presser

[57] ABSTRACT

An excellent pressure-sensitive copying material which has an excellent color developing rate, little odor, and neither offset nor bleeding, said copying material comprising an electron-accepting developer and a solution of an electron-donating color former which produces colors upon contacting with said color developer, wherein it is characterized in that the solvent of said solution comprises a mixture of 20 to 80 weight % of sec-butyldiphenylmethane, 5 to 50 weight % of sec-butyldiphenylethane (1,1) and 5 to 50 weight % of sec-butyldiphenylethane (1,2).

6 Claims, No Drawings

PRESSURE-SENSITIVE COPYING MATERIAL

DESCRIPTION

1. Technical Field

The present invention relates to a pressure-sensitive copying material. Particularly, the invention relates to an excellent pressure-sensitive copying material which has an excellent color developing rate, little odor, and neither offset nor bleeding.

2. Background Art

Heretofore, pressure-sensitive copying materials have been well known. For example, to one sheet of paper are applied microcapsules enclosing a solution of a colorless electron-donating color former (hereinafter referred to as "color former"), and to another sheet of paper is applied an electron-accepting developer (hereinafter referred to as "color developer") such as acidic inorganic materials, polymeric materials or aromatic carboxylic acids which can produce colors upon reacting with the above color former. When copying materials are used, the treated surfaces of the above-mentioned set of sheets are put together face to face and pressure is applied to the paired sheets, thereby obtaining duplicate recordings.

The recording mechanism of the type described above is such that the microcapsules are ruptured by the pressure of handwriting or the impact of typewriting to release the color former solution. The solution comes into contact with the color developer on the opposing surface of the other sheet of paper to produce a color. In another type of known recording material, these materials having color forming function are applied to one side of a sheet of paper.

The color former solution that is used for the recording material of this kind is a solution of an electron-donating color former in one or more kinds of hydrophobic solvents. The hydrophobic solvents employed here are required to have the properties as follows:

(a) innoxiousness,
(b) absence of disagreeable odor,
(c) colorlessness or quite light color,
(d) good dissolving property for color formers, and good stability of color former solution,
(e) easiness of microcapsulation,
(f) good storage stability of microcapsule,
(g) not to inhibit the color developing reaction, and the color developing rate is high,
(h) to produce color images without bleeding, and to produce clear color images even after they are left to stand for a long period of time,
(i) inexpensiveness, and
(j) little deterioration of color (smudge) during storage.

In the prior art, diarylalkanes such as phenylxylylethane and phenylethylphenylethane, alkylnaphthalenes such as diisopropylnaphthalene, alkylbiphenyls such as monoisopropylbiphenyl, aromatic hydrocarbons having two or more aromatic rings such as partially hydrogenated terphenyl, and chlorinated paraffins have been used as the solvents for recording material of this kind.

However, these solvents do not always satisfy the above requirements. Particularly, color developing property, odor of solvent, and bleeding and smudge in writing are usually contradictory to each other so that few solvents satisfy these requirements at the same time. Recently, as a solvent having little odor and high color developing rate, there is proposed a fraction mainly consisting of sec-butyldiphenylmethane and sec-butyldiphenylethane that is obtained by alkylating a heavier fraction produced as a by-product in ethylbenzene production, with butene (U.S. Pat. No. 4,686,548). The solvent obtained by this method is really satisfactory in color developing rate and odor; however, it is not always satisfactory in view of bleeding and smudge in writing.

DISCLOSURE OF INVENTION

The object of the present invention is to provide an excellent pressure-sensitive copying material which is free from the above-described disadvantages of the solutions used in the conventional recording materials and has particularly high color developing rate, little odor and little bleeding and smudge in writing.

The solvents for color former solution used in a pressure-sensitive copying material of the present invention is a mixture of 20 to 80 weight % of sec-butyldiphenylmethane, 5 to 50 weight % of sec-butyldiphenylethane (1,1) and 5 to 50 weight % of sec-butyldiphenylethane (1,2). The above three components make a total of 100 weight %.

The chemical structures of these compounds are as follows.

sec-Butyldiphenylmethane:

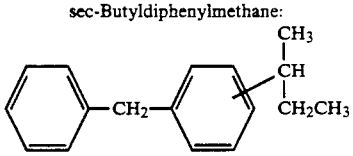

sec-Butyldiphenylethane (1,1):

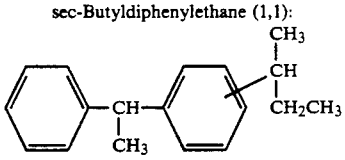

sec-Butyldiphenylethane (1,2):

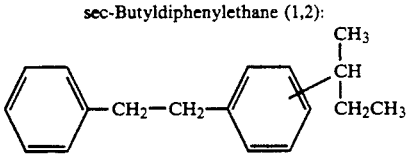

The substitution site of a sec-butyl group in every compound is not restricted.

The present invention will be described in more detail in the following.

The above-mentioned sec-butyldiphenylmethane, sec-butyldiphenylethane (1,1) and sec-butyldiphenylethane (1,2) can be produced easily by known methods. For example, there are known following methods: to alkylate diphenylmethane, diphenylethane (1,1) or diphenylethane (1,2) with an alkylating agent such as n-butene or sec-butyl chloride in the presence of an acidic catalyst; to benzylate sec-butylbenzene with an aralkylating agent such as benzyl chlorides or benzyl alcohols; to transalkylate sec-butylbenzene and diphenylmethane or diphenylethanes; or to couple sec-butylbenzene and benzene with ethylene dichloride.

The solvent used in the present invention is a mixture of the above three kinds of sec-butyldiarylalkanes. Therefore, the solvent can be produced by mixing the compounds together in a predetermined ratio which are prepared separately according to each procedure.

Furthermore, there are following methods to obtain the solvent composition of the present invention: to alkylate late diphenylmethane, diphenylethane (1,1) and diphenylethane (1,2) which are previously mixed in a predetermined ratio; or, to the contrary, to mix together sec-butyldiphenylmethane, sec-butyldiphenylethane (1,1) and sec-butyldiphenylethane (1,2) which are previously synthesized.

It is necessary that the solvent of the present invention contains sec-butyldiphenylmethane in 20 to 80 weight %, sec-butyldiphenylethane (1,1) in 5 to 50 weight % and sec-butyldiphenylethane (1,2) in 5 to 50 weight %.

When the amount of sec-butyldiphenylmethane is less than 20 weight %, the color developing rate is low. When the amount of sec-butyldiphenylmethane is more than 80 weight %, the bleeding in color developing and smudge in storage become a little troublesome. When the amount of sec-butyldiphenylethane (1,1) is less than 5 weight %, the effect to prevent bleeding and smudge in writing can not be found. On the other hand, when the amount of sec-butyldiphenylethane (1,1) is more than 50 weight %, the color developing rate lowers. When the amount of sec-butyldiphenylethane (1,2) is less than 5 weight %, it is difficult to meet the requirements of both the color developing rate and the odor. When the amount of sec-butyldiphenylethane (1,2) is more than 50 weight %, a problem of bleeding comes out in writing.

The present inventors examined the disadvantages encountered when the above known solvents are used separately and investigated the solution of the above problems. As the result, they found out that when these components are mixed in the specific ratio, the disadvantages of the components are mutually so compensated that an excellent solvent well-balanced in all properties such as color developing rate, odor, and bleeding and offset in writing can be obtained. Thus, the present invention was completed.

Furthermore, the above-mentioned solvent can be mixed together with other solvents known as solvents for pressure-sensitive paper in arbitrary ratio in the scope of the present invention, so long as sec-butyldiphenylmethane, sec-butyldiphenylethane (1,1) and sec-butyldiphenylethane (1,2) are contained in the stated ratio.

The electron-donating substances used as color formers in the present invention are colorless or lightcolored at normal temperatures and produce colors upon reacting with the electron-accepting substances. Any color former generally used in the technical field of the present invention can be employed.

Typical color formers are exemplified by triphenylmethane compounds such as 3,3-bis(p-dimethyl-aminophenyl)-6-dimethylaminophthalide (hereinafter sometimes referred to as "CVL"), 3,3-bis-(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis-(1,2-dimethylindole-3-yl)-5-dimethylaminophthalide, 3,3-bis-(1,2-dimethylindole-3-yl)-6-dimethylaminophthalide, 3,3-bis-(9-ethylcarbazole-3-yl)-5-dimethylaminophthalide, 3,3-bis-(2-phenylindole-3-yl)-5-dimethylaminophthalide, and 3-p-dimethylaminophenyl-3-(1-methylpyrrole-2-yl)-6-dimethylaminophthalide; diphenylmethane compounds such as 4,4'-bis-dimethylaminobenzhydrine benzyl ether, N-halophenyl leuco Auramine, and N-2,4,5-trichlorophenyl leuco Auramine; fluoran compounds such as Rhodamine B-anilinolactam, Rhodamine-(p-nitroanilino)lactam, Rhodamine B-(p-chloroanilino)-lactam, 7-dimethylamino-2-methoxyfluoran, 7-diethylamino-2-methoxyfluoran, 7-diethyl-amino-3-methoxyfluoran, 7-diethylamino-3-chlorofluoran, 7-diethylamino-3-chloro-2-methylfluoran, 7-diethylamino-2,3-dimethylfluoran, 7-diethylamino-(3-acetylmethylamino)-fluoran, 7-diethylamino-(3-methylamino)-fluoran, 3,7-diethylaminofluoran, 7-diethylamino-3-(dibenzylamino)fluoran, 7-diethylamino-3-(methylbenzylamino)-fluoran, 7-diethylamino-3-(chloroethylmethylamino)fluoran, 7-diethylamino-3-(diethylamino)fluoran, and 2-phenylamino-3-methyl-6-(N-ethyl-N-p-tolyl)-aminofluoran; thiazine compounds such as benzoyl leuco methylene blue and p-nitrobenzyl leuco methylene blue; and spiro compounds such as 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)-spiropyran, and 3-propyl-spiro-dibenzopyran.

As the color developers used in the present invention, there are organic materials such as acidic organic compounds, for example, aromatic carboxylic acids, acidic polymers such as polymers of aromatic carboxylic acids or their metal salts, carboxylated terpene phenol resins having polyvalent metal substituted or their derivatives, and acidic inorganic materials such as acid clays or activated clays.

The acidic polymers are exemplified by phenol resins such as p-phenylphenol-formaldehyde polymer and p-octylphenol-formaldehyde polymer. These are also used in forms of salts with polyvalent metals such as zinc. Furthermore, there are phenol-acetylene copolymer, maleic acid-rosin polymer, partially or completely saponified styrene-maleic anhydride copolymer, partially or completely saponified ethylene-maleic anhydride copolymer, carboxylated polyethylene, and partially or completely saponified vinyl methyl ether-maleic anhydride copolymer.

The aromatic carboxylic acids used as color developers are organic compounds which have aromatic rings (monocyclic or polycyclic) having carboxyl groups attached directly. The aromatic carboxylic acids are exemplified by salicylic acid derivatives such as: 3,5-di(α-methylbenzyl)-salicylic acid, 3-(α-methylbenzyl)-5-(α,α'-dimethylbenzyl)-salicylic acid, 3-(4'-α,α'-dimethylbenzyl)phenyl-5-(α,α'-dimethylbenzyl)-salicylic acid, 3,5-di-tert-butyl salicylic acid, 3,5-di-tert-octyl salicylic acid, 3-cyclohexyl-5-(α, -α'-dimethylbenzyl)-salicylic acid, 3-phenyl-5-(α,α'-dimethylbenzyl)salicylic acid, and 3,5-di(α,α'-methylbenzyl)-salicylic acid.

Furthermore, the aromatic carboxylic acids having styrenes attached such as styrene-salicylic acid are also exemplified. The most preferable aromatic carboxylic acids are those having total carbon number of 15 or more. However, when they are used as monomers for copolycondensation or copolymerization as described later, the carbon number is not restricted.

Furthermore, addition polymerization resins and condensation or copolycondensation resins containing aromatic carboxylic acid, especially salicylic acid as a comonomer, such as salicylic acid resin, can also be used as the color developers of the present invention. These kinds of resins are exemplified by copolycondensation resin consisting of salicylic acid and dialkoxy xylene, and polymerization product of salicylic acid and aldehyde. These resins can also comprise trialkylbenzenes as monomers for copolycondensation.

Furthermore, the salts of metals with the aromatic carboxylic acids or their polymers can be also used. The metals are exemplified by polyvalent metals such as zinc, aluminum, barium, tin, iron, calcium and lead.

The aromatic carboxylic acids or their polymers and their metal salts can be produced, for instance, according to the method described in U.S. Pat. No. 4,783,521.

The carboxylated terpene phenol resins having polyvalent metal substituted or their derivatives can be produced, for example, by condensing cyclic monoterpenes and phenols in the presence of an acidic catalyst to obtain copolycondensation resins, introducing carboxyl groups into said resins according to the known methods to obtain carboxylated terpene phenol resins, and treating the obtained resins with polyvalent metals. The examples of this method are disclosed in U.S. Pat. Nos. 4,759,797 and 4,749,680, and European Laid-Open Patent No. 275,110. More particularly, the carboxylated terpene phenol resins having polyvalent metal substituted are produced by condensing phenol and α-pinene with a catalyst of boron trifluoride into a copolycondensation resin, carboxylating this resin by introducing carbon dioxide in the presence of sodium metal, and then treating the product with polyvalent metals such as zinc chloride. In this case, the polyvalent metals are exemplified by zinc, aluminum, barium, tin, iron, calcium and lead. Zinc is most preferable. In the scope of the present invention, the carboxylated terpene phenol resins having polyvalent metal substituted or their derivatives can be also used by being mixed with aromatic carboxylic acids such as salicylic acid or their metal salts in a solvent or dispersant, or by being mixed on the melt.

A general production method of the pressure-sensitive copying material using the solvent of the present invention will be described with reference to an example of pressure-sensitive copying paper.

The solution which contains the above color former in a solvent of the present invention is emulsified in an aqueous mixed solution of gelatin and gum arabic, and then gelatin membranes are formed around the emulsified oil particles by coacervation method. Recently, methods to microcapsulate with synthetic resins by in-situ polymerization or interfacial polymerization are also widely used.

The thus obtained fine oil drop-like capsulated emulsion is applied to one sheet of paper, and the foregoing color developer is applied to the opposing surface of the other sheet of paper or to the above applied surface in layers to produce the pressure-sensitive copying material.

The pressure-sensitive copying material of the present invention is free from the disadvantages of the conventional one which is obtained using a solvent comprising of sec-butyldiphenylmethane and sec-butyldiphenylethane, that is, is excellent in the color developing rate, odor, and bleeding and smudge in writing.

BEST MODE FOR CARRYING OUT THE INVENTION

The present invention will be described in more detail with reference to examples. However, the invention is not restricted to the following examples.

As shown in the following Table 1, sec-butyldiphenylmethane, sec-butyldiphenylethane (1,1) and sec-butyldiphenylethane (1,2) were used to prepare the solvent for pressure-sensitive copying paper. As the color former, CVL was dissolved into the solvents in 5% each to obtain color former solutions.

In Table 1, solvent 1, solvent 2 and solvent 3 are the solvents used for the pressure-sensitive copying materials of the present invention, and solvent 4, solvent 5 and solvent 6, solvent 7 are comparative ones.

Thereafter, these solvents were microcapsulated by in-situ polymerization using urea and formaldehyde. Bonding agent and protecting materials were added to the obtained microcapsule emulsion, and these were applied to sheets of fine quality paper with a Mayer bar to obtain upper sheets of the pressure-sensitive copying paper.

The surface applied with microcapsule of the upper sheet was put over the surface of the lower sheet applied with phenol-formaldehyde resin as color developer, and impact loads were applied to produce colors. The color densities at 5 seconds and 60 minutes after applying the impact loads were determined by a reflective spectrophotometer. Furthermore, the developed color images of the lower sheet were observed with a magnifying glass to determined the degree of bleeding of the color images.

Subsequently, the color density at 60 minutes after applying static load of 20 kg/cm$^2$ was determined, and the smudge under light static load was examined.

The results are shown in the following Table 1.

TABLE 1

| Solvent | 1 | 2 | 3 | 4 | 5 | 6 | 7 |
|---|---|---|---|---|---|---|---|
| Composition (%) | | | | | | | |
| sec-Butyl diphenylmethane | 50 | 30 | 70 | 45 | 40 | 10 | 90 |
| sec-Butyldiphenyl ethane (1,1) | 25 | 40 | 10 | 55 | 0 | 25 | 5 |
| sec-Butyldiphenyl ethane (1,2) | 25 | 30 | 20 | 0 | 60 | 65 | 5 |
| Developed Color Density (%) | | | | | | | |
| After 5 sec. | ○ | ○ | ◎ | Δ | Δ | Δ | ◎ |
| After 60 min. | ◎ | ◎ | ◎ | ◎ | ◎ | ◎ | ◎ |
| Odor | Good | Good | Good | Good | Good | Good | Good |
| Color Density (%) Developed by Static Load | 5 | 4 | 5 | 4 | 7 | 3 | 9 |
| Bleeding of Color Image | Slight | Slight | Slight | Slight | Moderate | Moderate | Much |

Notes: Color Density After 5 sec. After 60 min.

TABLE 1-continued

| | | |
|---|---|---|
| Δ | Less than 60% | — |
| ○ | 60–64% | Less than 80% |
| ◎ | More than 65% | More than 80% |

As will be understood from Table 1, the pressure-sensitive copying material obtained using the solvent of the present invention is excellent in both color developing rate and odor, suffers from little deterioration of color under load during storage, and has clear and superior color images. These effects obtained by mixing the specific components in the specific ratio have been hitherto unknown, and can be hardly predicted from the conventional art.

INDUSTRIAL APPLICABILITY

The pressure-sensitive copying material of the present invention has high color developing rate, little odor and neither offset nor bleeding in writing so that clear color images can be quickly obtained.

We claim:

1. A pressure-sensitive copying material comprising a sheet coated with microcapsules containing therein a solution of an electron-donating color former, said solvent for said electron-donating color former solution including a mixture of 20 to 80 weight percent of sec-butyldiphenylmethane, 5 to 50 weight percent of sec-butyldiphenylethane (1,1) and 5 and 50 weight percent of sec-butyldiphenylethane (1,2).

2. A pressure-sensitive copying material in accordance with claim 1 wherein said sheet is paper.

3. A pressure-sensitive copying material in accordance with claim 2 wherein the electron-donating color former of said electron-donating color former solution is selected from the group consisting of a triphenylmethane compound, a diphenylmethane compound, a fluoran compound, a thiazine compound and a spiro compound.

4. A pressure-sensitive copying material in accordance with claim 1 further comprising an electron-accepting color-developer.

5. A pressure-sensitive copying material in accordance with claim 4 wherein said electron-accepting color developer is an aromatic carboxylic acid, an acidic organic polymer or an acidic inorganic material.

6. A pressure-sensitive copying material in accordance with claim 5 wherein said acidic organic polymer is selected from the group consisting of phenol resins, metal salts of phenol resins, polymers of aromatic carboxylic acids, metal salts of aromatic carboxylic acid polymers and carboxylated terpene phenol resins.

* * * * *

UNITED STATES PATENT AND TRADEMARK OFFICE

CERTIFICATE OF CORRECTION

PATENT NO. : 5,264,409

DATED : November 23, 1993

INVENTOR(S) : Naoya Takahashi, et al.

It is certified that error appears in the above-indentified patent and that said Letters Patent is hereby corrected as shown below:

Column 3, line 5: delete "late"

Column 8, line 6, Claim 1: "5 and 50" should read --5 to 50--

Signed and Sealed this

Ninth Day of August, 1994

Bruce Lehman

*Attest:*

BRUCE LEHMAN

*Attesting Officer*

*Commissioner of Patents and Trademarks*